United States Patent [19]

Torres

[11] 4,014,055

[45] Mar. 29, 1977

[54] SHEET-SPREAD WITH INTEGRAL PILLOW RETAINING SLEEVE

[76] Inventor: Susan Torres, c/o Mrs. G. Mendez, P.O. Box 40, Jackson, N.J. 08527

[22] Filed: Jan. 27, 1975

[21] Appl. No.: 544,636

[52] U.S. Cl. ..... 5/334 C

[51] Int. Cl.[2] ..... A47G 9/00

[58] Field of Search ..... 5/334 R, 334 C, 335, 5/336, 354 R, 354 C

[56] References Cited

UNITED STATES PATENTS

| | | | |
|---|---|---|---|
| 1,867,425 | 7/1932 | Swetzel | 5/334 C |
| 2,623,221 | 12/1952 | Hickman | 5/334 C |
| 3,020,566 | 2/1962 | Anderson et al. | 5/334 C |

*Primary Examiner*—Paul R. Gilliam
*Assistant Examiner*—Andrew M. Calvert
*Attorney, Agent, or Firm*—Jack D. Slobod

[57] ABSTRACT

A sheet-spread includes an integral elongated sleeve formed from a fold of cloth secured to the body portion along a line parallel to the transverse axis thereof and adapted to retain one or more pillows.

1 Claim, 4 Drawing Figures

SHEET-SPREAD WITH INTEGRAL PILLOW RETAINING SLEEVE

BACKGROUND OF THE INVENTION

The field of the invention relates to bedding and particularly to sheets. A common problem involves the maintenance of an orderly appearance for bedding. Frequently on arising in the morning there is insufficient time to neatly make the bed. Various prior art structures have been provided having a very general similarity to the apparatus of the present invention. These structures in general have been directed primarily to the aspect of providing a sheet having integral therewith a covering for one or more pillows. The object of said structures is to minimize the number of itmes of bedding which need to be washed and purchased. Structures of this general type are shown in the following U.S. Pat. Nos.: Schiller, 2,462,780; Rook, et al, 2,217,819; Bellinger, 2,577,178 and Valentine, 3,800,340.

It is a primary object of the invention to provide apparatus which will facilitate the rapid and easy covering of a bed in a manner which creates a neat and orderly appearance.

Still another object of the invention is to provide apparatus which is simple and inexpensive to manufacture.

SUMMARY OF THE INVENTION

It has now been found that these and other objects of the invention may be attained by a combination sheet and bedspread, hereinafter referred to as a sheet-spread. The sheet-spread is provided with an elongated sleeve formed of a loop of cloth, affixed to the body portion of the sheet-spread at a line along the circumference thereof which is generally parallel to the longitudinal axis thereof. The longitudinal axis of the sleeve is normally affixed to the body of the sheet-spread along a line, which is transverse to the length of the bed and positioned such that the sleeve circumference registers with the top edge of the sheet-spread when one or more pillows are disposed therein with the sheet-spread is disposed on an associated bed. Ordinarily the sheet-spread will comprise a generally rectangular body portion having dimensions substantially the same as an associated bed with which it is used and a depending flounce, which covers the sides of the bed. The sleeve is ordinarily provided with a generally longitudinally extending opening for selective insertion and removal of the associated pillows. Ordinarily the opening will be disposed along a portion of the sleeve which is intermediate the line along which it is affixed to the body of the sheet-spread and the portion of the sleeve which registers with the top of the bed when installed. More particularly the slot will be disposed on the undersurface of the sleeve so that access to the slot is obtained by pivotal motion of the sleeve about the line at which the sleeve is affixed to the body of the sheet-spread.

In one form the sheet-spread will have a section dimensioned and configured for engagement with the underside of the associated mattress and having an elastic member for snug fitting engagement therewith.

BRIEF DESCRIPTION OF THE DRAWING

The invention will be better understood by reference to the accompanying drawing in which.

DESCRIPTION OF THE PREFERRED EMBODIMENT

Figure 1:
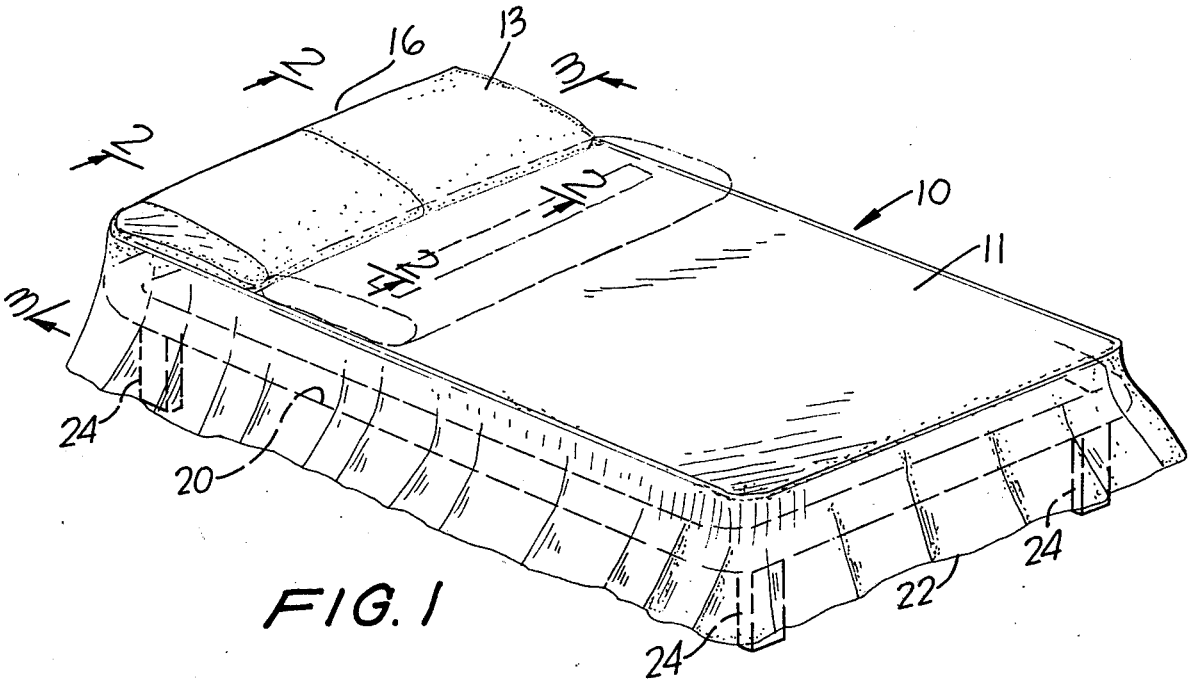
FIG. 1 is a perspective view of the apparatus in accordance with the invention.
Figure 2:
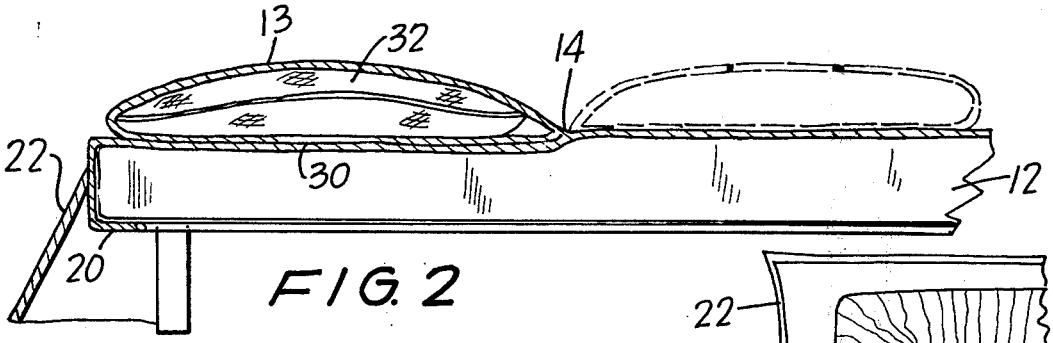
FIG. 2 is a sectional view to be taken along line 2—2 of FIG. 1.
Figure 4:
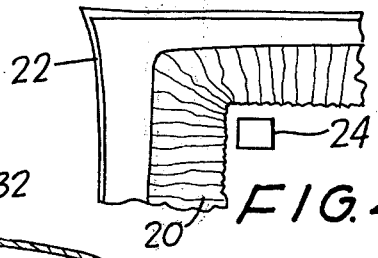
FIG. 4 is a broken away view of the bottom of the installed sheet-spread in accordance with the invention taken along line 4—4 of FIG. 3.
Figure 3:
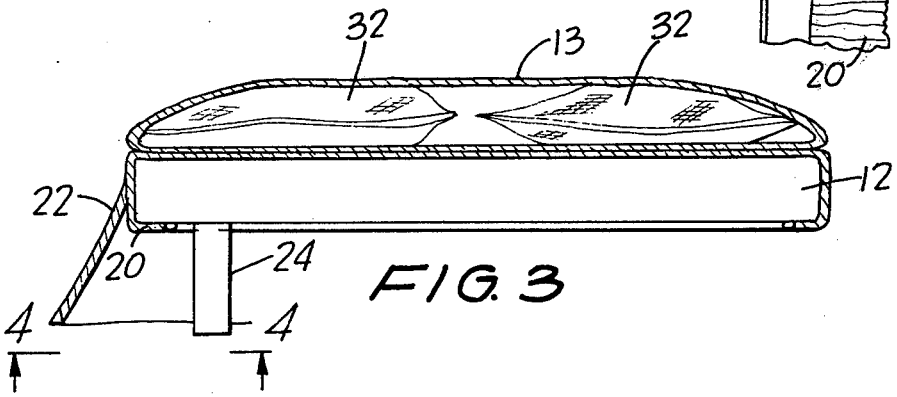
FIG. 3 is a sectional view taken along the line 3—3 of FIG. 1.

Referring now to FIGS. 1 through 4 there is shown a sheet-spread 10 in accordance with the invention. The sheet-spread 10 includes a generally rectangular body portion 11 having a width and length which is substantially the same as the bed 12 with which it is associated. The edges of the body portion 11 when installed are disposed generally in aligned relationship and proximate to the edges of the top of the bed 12. A sleeve 13 is affixed to the body portion 11 transverse along a line 14 which is parallel to the top of the bed 16 and in spaced relationship thereto. The sleeve 13 is elongated and preferably has its longitudinal axis extending completely across the width of the bed and is dimensioned and configured for containing one or more pillows and/or blankets. When filled with a pillow the sleeve will extend so that the extremity thereof nearest the top 16 of the bed extends to meet a plane defined by the top 16 or head end of the bed 12. Fixed to the body portion 11 is a depending circumferential section 20 dimensioned and configured for engaging the underside of the mattress or in some forms the underside of the boxspring of the bed 12. The engagement is shown best in FIG. 4 and it will be understood that this section is elasticized in the manner of a fitted bed-sheet to insure that the body portion 11 of the spread 10 is firmly secured to the bed 12 to avoid any wrinkles as well as to avoid tendencies to wrinkle. Also extending circumferentially around the body portion is a flounce 22 which is disposed above the depending circumferential section 20 which engages the mattress or boxspring and which presents the usual draped effect which is present in bedspreads and which hide the legs 24.

In most applications the sleeve will have disposed on the back side thereof, an opening 30, which extends generally axially along a line which is parallel to the longitudinal axis thereof. The slot or opening 30, which is exposed when the sleeve is pivoted along the line which joins it to the body portion, provides for easy removal and installation of associated pillows 32, 32 within the sleeve 13 which may be pivoted to the position shown in phantom in FIG. 2.

In operation the user thereof may remove and store elsewhere the blankets, not shown, which are ordinarily used or alternatively, the blankets may be stored with the pillows within the sleeve 13 of the sheet-spread 10 in accordance with the invention.

Preferably, the same pillows are used for sleeping as are used in the sleeve day to day. The pillows therefore may be placed within the spread in accordance with the invention or removed for sleeping thereon. When the pillows are left within the sleeve for sleeping the primary advantage is that the pillows are held in a manner which ensures their neat and orderly positioning and time is saved in day to day use. Thus it is apparent that upon removal of the blanket the bed is made.

Having thus described my invention, I claim:

1. A sheet-spread device comprising a generally rectangular body portion of cloth, said body portion including edges which correspond to the top, bottom and sides of a bed adapted to receive said sheet-spread, said generally rectangular portion having a width and length corresponding to said associated bed, a pillow receiving tubular sleeve having the axis thereof disposed transversely to the length of the generally rectangular portion, said sleeve being joined to said rectangular portion along a longitudinal line on the circumference thereof disposed generally parallel to the axis thereof, said line being spaced from the top of the generally rectangular section a distance such that when the sleeve has a pillow disposed therein the extremity of the sleeve registers with the top of the generally rectangular section, said sheet-spread further comprises a depending retaining section having a peripherally disposed elastic member for tight fitting engagement with the bed; and a depending flounce over said retaining section.

* * * * *